United States Patent [19]

San Miguel

[11] 4,073,985

[45] Feb. 14, 1978

[54] COMPOSITE DOME

[75] Inventor: Anthony San Miguel, Ridgecrest, Calif.

[73] Assignee: The United States of America as represented by the Secretary of the Navy, Washington, D.C.

[21] Appl. No.: 705,223

[22] Filed: July 14, 1976

[51] Int. Cl.[2] ..... F42B 15/02

[52] U.S. Cl. ..... 428/35; 102/105; 244/121; 250/338; 250/342; 250/347; 350/128; 428/116; 428/119; 428/913; 428/918

[58] Field of Search ..... 428/35, 116, 913, 918, 428/119; 52/80, 81; 102/105; 350/109, 2, 16, 128, 213, 129; 343/872; 264/32, DIG. 64; 244/1 R, 121; 250/510, 342, 338, 353, 347; 156/99, 293

[56] References Cited

U.S. PATENT DOCUMENTS

| | | | |
|---|---|---|---|
| 2,512,257 | 6/1950 | Pfund | 350/2 |
| 3,183,775 | 5/1965 | Robison | 350/128 |
| 3,652,850 | 3/1972 | Briggs | 250/347 |
| 3,676,976 | 7/1972 | McAllister | 52/81 |
| 3,724,386 | 4/1973 | Schmidt | 102/105 |
| 3,841,039 | 10/1974 | Farnsworth | 52/81 |
| 3,875,408 | 4/1975 | Pusch | 250/338 |

FOREIGN PATENT DOCUMENTS

| | | | |
|---|---|---|---|
| 886,051 | 1/1962 | United Kingdom | 350/2 |

OTHER PUBLICATIONS

Isomet Technical Bulletin 157, Apr. 1, 1957.

Dubner, H., "Optical Design for Infrared Missile Seekers", Proceedings of the IRE, pp. 4,2.2, vol. 47, Sept. 1959.

*Primary Examiner*—George F. Lesmes
*Assistant Examiner*—Stanley S. Silverman
*Attorney, Agent, or Firm*—R. S. Sciascia; Roy Miller

[57] ABSTRACT

A dome for protecting energy responsive instrumentation in a missile is disclosed which utilizes a plurality of wedge shaped transparent elements mounted in a polymer matrix. The transparent elements are arranged so that aerodynamic pressure acting on the dome compresses each transparent element and prevents dome implosion. Individual elements may crack under excessive aerodynamic load, but are held in place by adjacent elements and by aerodynamic pressure, and retain their optical transmissivity during final trajectory to the target.

9 Claims, 5 Drawing Figures

COMPOSITE DOME

BACKGROUND OF THE INVENTION

1. Field of the Invention

This invention pertains to transparent domes for use in missiles, and more particularly to such domes which retain their transmissivity and structural integrity under high aerodynamic loads.

2. Description of the Prior Art

Transparent domes used in missiles serve to shield energy responsive instrumentation from aerodynamic loads while transmitting radiant energy in preselected wavelengths. In missiles which attain supersonic velocity, the transparent dome must be able to survive aerothermodynamic heating. State of the art materials, such as IRTRAN, crack when subjected to supersonic environments because of thermally induced stresses which develop in the material. Those materials which are able to survive a supersonic environment are generally expensive and limit the window of available frequencies which may be transmitted.

Solid crystal domes, when damaged by thermal stresses or aerodynamic pressure, experience catastrophic failure once the structural integrity of the dome shape is damaged. Failure of the protective dome in a supersonic missile rapidly leads to destruction of the guidance sensor mechanism or other instrumentation normally protected by the dome, and thus destroys the guidance capability of the missile.

SUMMARY OF THE INVENTION

The composite dome defined by this invention overcomes the limitations of prior art domes by utilizing a plurality of wedge shaped transparent elements retained within a polymer matrix that maintains the structural integrity of the dome. Although the individual transparent elements may become cracked from thermal or pressure stresses, their wedge shape coupled with positive aerodynamic pressure keeps them compressed within the polymer matrix and thus prevents damage to the dome which would lead to catastrophic failure.

The transparent elements may be manufactured from rock salt, which has excellent transmissivity in the range between 0.1 and 12 micrometers. Rock salt elements would, of course, require a protective coating such as selenium on the exposed external surface to prevent water erosion. The elements could also be manufactured from any other material having beneficial transmissivity characteristics. The individual transparent elements could be hexagonal, triangular, conical or any other shape as long as the sides are tapered to produce a wedge configuration. The polymer matrix could be manufactured from polyimide or any other material having a high temperature resisting capability.

When the composite dome equipped missile reaches supersonic velocity, the life of the dome is directly a function of the life of the polymer used in the matrix. Thus, composite dome life is determined by the chemical degradation temperature and the thickness of the polymer material selected.

BRIEF DESCRIPTION OF THE DRAWINGS

Further advantages of the present invention will emerge from a description which follows of a possible embodiment of a composite dome according to the invention given with reference to the accompanying drawing figures, in which.

DESCRIPTION OF THE PREFERRED EMBODIMENT

Figure 1:
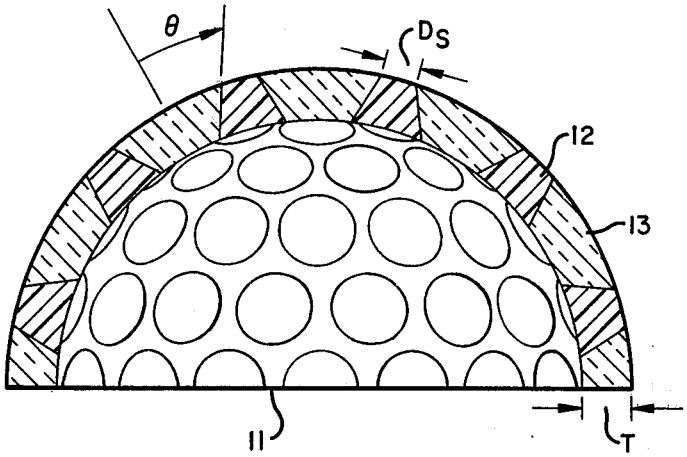
FIG. 1 illustrates a sectional view of a composite dome utilizing conical transparent elements according to the invention.

Referring now to the drawing figures, wherein like reference numerals correspond to like parts and elements throughout the several figures, there is shown, in FIG. 1, composite dome 11 comprising polymer matrix 12 and transparent elements 13.

The radiation transmitting area of dome 11 is inversely proportional to the separation distance $D_2$, the matrix thickness T, and the wedge angle $\theta$. The optimum size for an individual transparent element depends upon the mechanical properties of the material selected. Stronger materials may be used to construct larger elements, whereas materials having less strength may only be useful in constructing smaller elements. Of course, a dome of a given size will accomodate a larger number of elements as the dimensions of each individual element decreases, and the transmission area will increase with the number of transparent elements. Therefore, the transmission area of the dome may be adjusted by adjusting the various parameters of the transparent elements.

Figure 2:
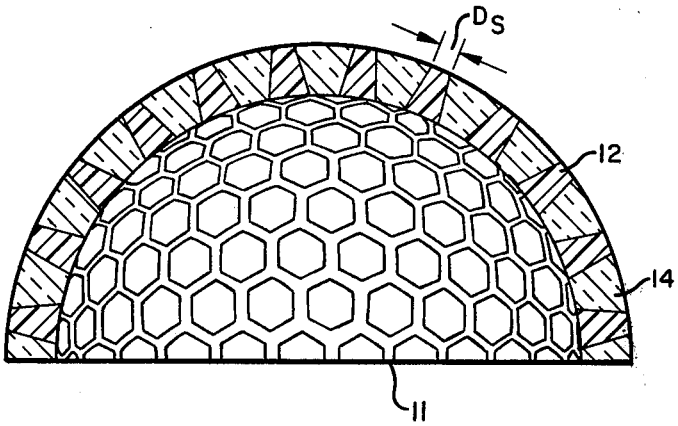
FIG. 2 illustrates a sectional view of a composite dome utilizing hexagonal transparent elements according to the invention.
Figure 3:
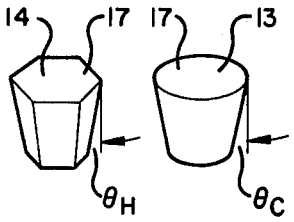
FIG. 3 illustrates a perspective view of conical and hexagonal transparent elements.

FIG. 2 illustrates a composite dome identical to that shown in FIG. 1 except that the individual transparent elements 14 have a hexagonal rather than a circular section. This difference is more clearly shown in FIG. 3 where hexagonal element 14 is shown with hexagonal taper $\theta_H$, and conical element 13 is shown with conical taper $\theta_C$.

Figure 4:
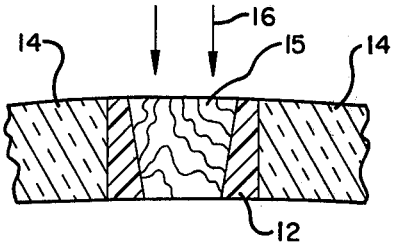
FIG. 4 illustrates the failure mode of a single transparent element shown by a fragmentary sectional view.

FIG. 4 illustrates the failure mode of a fractured transparent element 15 which has been subjected to aerodynamic pressure and aerothermodynamic heating. Fractured transparent element 15, although no longer physically intact, is held rigidly in place by aerodynamic pressure 16 and the wedging action of its taper. Thus dome implosion is prevented by the wedging action of fractured element 15 against polymer matrix 12 which in turn is supported by adjacent transparent elements 14.

Figure 5:
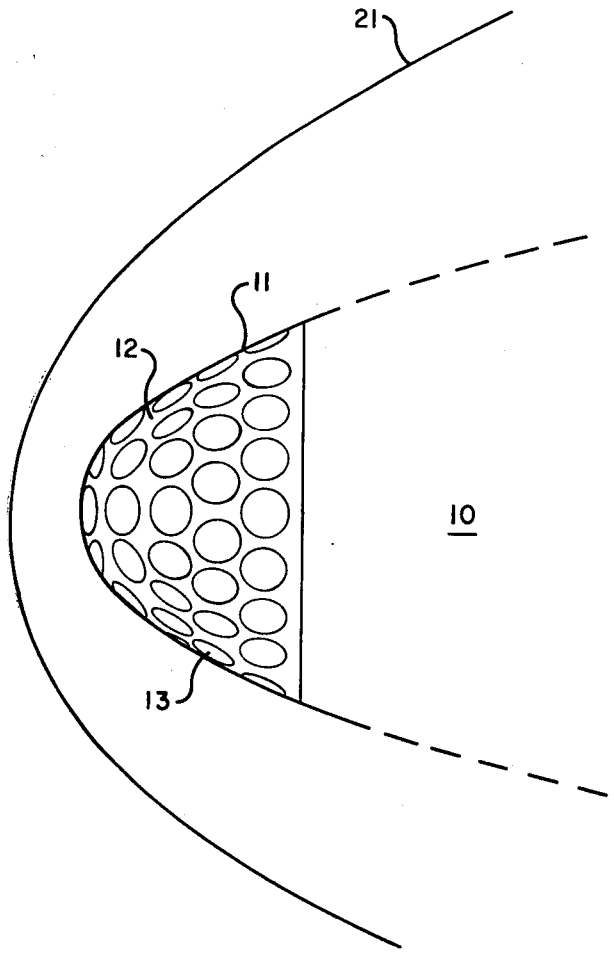
FIG. 5 illustrates a composite dome according to the invention mounted on a supersonic missile.

FIG. 5 illustrates composite dome 11 installed upon supersonic missile 10. Bow shock 21 is shown in its approximate location as supersonic missile 10 travels through air.

Of course any transparent material could be used for transparent element 13, and the configuration chosen would depend upon the mechanical properties of the material as well as the transmission area desired. Likewise, any polymer material which exhibits high temperature resistance or a high chemical degradation temperature could be used for polymer matrix 12, and polyimide is only one example of such a material. Many different types of plastics would work equally well for polymer matrix 12. If rock salt is chosen for transparent element 13, a protective coating of selenium or similar material should be applied to the exposed surface of element 13 or 14 at 17 to prevent water absorption or erosion. The thickness of the selenium layer at 17 need only be approximately 0.0002 inches in thickness to provide adequate protection.

Under severe supersonic or hypersonic conditions, polymer matrix 12 may chemically degrade by pyrolysis, ablation, or burning but would not be likely to crack and fail catastrophically. Thus the life to be expected from a composite dome is directly dependent upon the thickness and temperature resisting capability of matrix 12. Matrix materials having a chemical degradation temperature in excess of 500° F are to be preferred for sufficiently long dome life to permit the missile to reach its target.

The invention has been described in an illustrative manner and it is to be understood that the terminology which has been used is intended to be in the nature of words of description rather than of limitation. The dimensions and relative proportions indicated by the figures are for purposes of illustration only and are not necessarily proportioned in the manner that an actual embodiment of the invention would possess. Obviously, many modifications and variations of the present invention are possible in the light of the above teachings. It is therefore to be understood that within the scope of the appended claims the invention may be practiced otherwise than as specifically described.

What is claimed is:

1. A transparent shell, having a concave and convex surface, for protecting energy responsive instrumentation in a missile, said shell comprising:

a plurality of discrete, wedge-shaped, transparent optical elements having their smaller ends flush with said concave surface and their larger ends flush with said convex surface, said elements arranged adjacently so as to have interstices therebetween to form a dome; and a continuous high temperature resistant polymer matrix positioned in the interstices between said discrete, wedge-shaped, transparent optical elements, and rigidly holding said discrete, wedge-shaped, transparent optical elements in place.

2. The shell defined by claim 1 wherein said transparent optical elements have a truncated conical shape.

3. The shell defined by claim 1 wherein said transparent optical elements have a truncated pyramidal shape.

4. The shell defined by claim 1 wherein said transparent optical elements transmit radiant energy at wavelengths within the range of from 0.1 micrometers to 12 micrometers.

5. The shell defined by claim 1 wherein said transparent optical elements comprise rock salt.

6. The shell defined by claim 1 wherein said transparent optical elements have a protective layer of selenium.

7. The shell defined by claim 1 wherein said high temperature resistant polymer matrix comprises polyimide.

8. The shell defined by claim 1 wherein said high temperature resistant polymer matrix has a chemical degradation temperature which exceeds 500° F.

9. The shell defined by claim 1 wherein said dome defines a hemisphere.

* * * * *